US010302360B2

(12) United States Patent
Shea

(10) Patent No.: US 10,302,360 B2
(45) **Date of Patent: *May 28, 2019**

(54) THERMOPLASTIC KETTLE AUXILIARY HEAT EXCHANGER SYSTEM

(71) Applicant: James P. Shea, Waterford, MI (US)

(72) Inventor: James P. Shea, Waterford, MI (US)

( * ) Notice: Subject to any disclaimer, the term of this patent is extended or adjusted under 35 U.S.C. 154(b) by 147 days.

This patent is subject to a terminal disclaimer.

(21) Appl. No.: 15/424,467

(22) Filed: Feb. 3, 2017

(65) Prior Publication Data

US 2018/0031320 A1 Feb. 1, 2018

Related U.S. Application Data

(60) Provisional application No. 62/368,468, filed on Jul. 29, 2016.

(51) Int. Cl.

| | |
|---|---|
| ***F27B 9/10*** | (2006.01) |
| ***F27B 9/14*** | (2006.01) |
| ***E01C 23/24*** | (2006.01) |
| ***F27D 27/00*** | (2010.01) |
| *F27B 9/02* | (2006.01) |
| *F27D 3/00* | (2006.01) |
| *F27B 14/14* | (2006.01) |

(52) U.S. Cl.

CPC ..... *F27B 9/145* (2013.01); *E01C 23/24* (2013.01); *F27D 27/00* (2013.01); *F27B 14/14* (2013.01); *F27B 2009/027* (2013.01); *F27D 2003/0087* (2013.01)

(58) Field of Classification Search

CPC ..... F27B 9/145; F27B 9/023; F27B 9/027; F27B 9/068; F27B 14/14; F27B 2009/027; E01C 23/24; F27D 27/00; F27D 2003/0087; F27D 2003/0018

USPC ..... 126/343.5 A, 343.5 R

See application file for complete search history.

(56) References Cited

U.S. PATENT DOCUMENTS

| | | | | |
|---|---|---|---|---|
| 1,709,016 A * | 4/1929 | Hendricks | C10C 3/12 | 122/239 |
| 2,515,136 A * | 7/1950 | Pigott | B29B 13/022 | 126/343.5 A |
| 4,416,614 A * | 11/1983 | Moody | F23Q 9/045 | 126/343.5 A |
| 4,418,681 A * | 12/1983 | Moody | E01C 19/1004 | 126/343.5 A |
| 4,623,279 A * | 11/1986 | Smith | B05C 5/001 | 118/305 |

(Continued)

*Primary Examiner* — Gregory L Huson
*Assistant Examiner* — Daniel E Namay
(74) *Attorney, Agent, or Firm* — Brinks Gilson & Lione

(57) ABSTRACT

An auxiliary heating means for improving the melting efficiency of melter kettles used to melt thermoplastic pavement marking materials. The auxiliary heating means includes a tube assembly through which thermoplastic material received from the bottom of the melter kettle is transferred to the top of the melter kettle. The tube assembly comprises an odd number of tubes having augers therein. The tube assembly is coupled to a side portion of the melter kettle and located within a heat chamber through which hot combustion gases from a combustion chamber at the bottom of the melter kettle flow and transfer heat into the tube assembly. The heat chamber comprises an extended portion of a heat chamber that surrounds the melter kettle.

20 Claims, 8 Drawing Sheets

(56) References Cited

U.S. PATENT DOCUMENTS

| | | | | |
|---|---|---|---|---|
| 4,905,663 | A * | 3/1990 | Magee | C10C 3/12 126/343.5 A |
| 5,252,808 | A * | 10/1993 | Morgan | B08B 9/08 126/343.5 A |
| 8,608,370 | B1 * | 12/2013 | Fishman | C21C 5/5241 266/234 |
| 2005/0115558 | A1 * | 6/2005 | Farmer | C10C 3/12 126/343.5 A |
| 2014/0083638 | A1 * | 3/2014 | Waniuk | H05B 6/26 164/47 |
| 2016/0138868 | A1 * | 5/2016 | Bosworth et al. | C21C 5/5247 266/44 |
| 2017/0227291 | A1 * | 8/2017 | Shea | F27D 27/00 |
| 2017/0299265 | A1 * | 10/2017 | Shea | F27D 3/0025 |
| 2018/0066892 | A1 * | 3/2018 | Shea | F27D 3/0025 |

* cited by examiner

THERMOPLASTIC KETTLE AUXILIARY HEAT EXCHANGER SYSTEM

RELATED APPLICATION

The present application is based upon U.S. Provisional Application Ser. No. 62/368,468, filed Jul. 29, 2016 to which priority is claimed under 35 U.S.C. § 120 and of which the entire specification is hereby expressly incorporated by reference.

BACKGROUND

The present invention relates generally to melter kettles that are designed and used to melt thermoplastic materials that are applied to pavements such as roadways, airport runways, parking lots, bicycle paths and other surfaces requiring pavement markings. More particularly the present invention is directed to systems and methods to improve the melting efficiency of melter kettles.

Thermoplastic materials are the product of choice for many types of pavement marking operations. However, unlike most other types of marking materials thermoplastic materials must be melted to very high temperatures that can reach up to about 420° F. in order to be fluid enough to be applied.

Early types of thermoplastic material application equipment applied the thermoplastic material at slow rates. Therefore, the long melting times it took to melt thermoplastic materials in melter kettles were not a problem. Melter kettles could keep up with the low output of application equipment.

Eventually improvements in the designs of melter kettles achieved reductions of melting times. However, over time application equipment was improved to the point at which thermoplastic material could be applied at much faster rates than the improved kettles could keep up with melting the thermoplastic material. The present invention increases the efficiency of melting thermoplastic in melter kettles that can be mounted on either thermoplastic trucks, nurse trucks, trailers or the like.

For some time heat domes, also called heat risers or heat tubes, have been installed in melter kettles. The dome structure is formed by a tube of variable diameter that is attached to a hole in the base of a kettle where the OD of the dome base matches the ID of the hole in the base of the kettle. The top of the dome is closed by a metal disc. The dome reduces the heating surface area of the base. However, the dome provides additional circumference surface area that compensates for the loss of the heating area in a kettle with no dome and compensates for the lost surface area of the base within a few inches of dome height. From this point the dome adds melting (heat transfer) surface area to the kettle with a dome as compared to a kettle without a dome thereby increasing the overall heating surface area in the kettle that acts on thermoplastic material in the kettle. This reduces the ratio of thermoplastic material to melting (heat transfer) surface area of the kettle which improves heating efficiency. Additionally, heating thermoplastic material in a melter kettle from the middle of the kettle in an outwardly direction is more efficient than heat transfer from the outside of the kettle in an inward direction. Heat domes have reduced melting times in kettles. However, heated air in the dome cools as heat transfers through the dome wall and into the thermoplastic kettle. Melting times are reduced with the use of domes but still needed to be improved.

A recent improvement in melter kettle efficiency has been developed by the present inventor and is disclosed in U.S. provisional application Ser. No. 62/291,316, entitled "HEAT DOME TEMPERATURE REGULATING SYSTEM," filed Feb. 4, 2016. In this copending application a heat dome chimney stack tube is attached to the top center of a heat dome about which an agitator drive shaft tube rotates. Hot combustion gases travel from the heat dome up the center of the heat dome chimney tube stack and vent into a top tube drive shaft heat chamber that has driveshaft tube relief vents through which combustion gases vent into the atmosphere. The venting of the combustion gases can be regulated by providing a rotational vent relief collar about the top tube drive shaft heat chamber. This system exhausts combustion gases from the dome that has been heat depleted thereby allowing a continual flow of hot combustion gases to maximize/optimize efficient temperature in the dome such that the maximum amount of heat is transferred through the dome and chimney stack surface areas into the thermoplastic material in the kettle. In this system the heat dome chimney stack tube and rotational drive shaft become heating surfaces through the centerline of the melter kettle. This system improves the rate of thermoplastic melting.

Another recent improvement in melter kettle efficiency developed by the present inventor is disclosed in U.S. provisional application Ser. No. 62/322,640, entitled THERMOPLASTIC MELTING KETTLE MATERIAL CIRCULATION SYSTEM, filed Apr. 14, 2016. In this improvement a single vertical material transfer tube is affixed to the side of the thermoplastic melter kettle either directly to the kettle side wall or to the outer insulation skin. The tube is attached to ports at the bottom and top of the melter kettle and an auger rotated by a direct drive motor within the vertical material transfer tube moves molten material from the bottom of the kettle to the top. When the vertical material transfer tube is connected directly to the kettle outer wall the bottom interface is within the heat chamber's outer wall.

When the vertical material transfer tube is affixed to the outer insulation skin there is an extended heat chamber surrounding the vertical material transfer tube. A port larger in diameter than the lower material transfer tube allows heat from the combustion chamber to contact the vertical material transfer tube.

Another recent improvement in melter kettle efficiency developed by the present inventor is disclosed in U.S. provisional application Ser. No. 62/291,309, entitled THERMOPLASTIC KETTLE AUXILIARY HEAT EXCHANGER SYSTEM, filed Feb. 4, 2016. This invention combines an odd number of interconnected vertical tubes within an oil bath through which heated heat transfer oil flows. The function of the system is to increase the temperature of molten thermoplastic moving through the circuit of interconnected heat transfer tubes by action of an independent high BTU output furnace that heats circulated heat transfer oil that circulates around the interconnected tubes. Molten thermoplastic enters the base of the first tube through a kettle bottom material flow port and the tube bottom material flow port both of which are isolated from the oil bath. The molten thermoplastic reenters the kettle at the top center through the top flow tube that connects to the top of the discharge tube that is above the level of the kettle top and is isolated from the oil bath. Each tube contains an auger. The augers are interconnected by a gear train. A single hydraulic motor attached to any auger drives each gear and auger in a counter rotational direction. This circulates the molten thermoplastic material from the bottom of the kettle where it is hottest through the kettle bottom material flow port into the bottom of the first tube then up and down the plurality of tubes. The material flows up the last tube and through a tube top port which is isolated from the oil bath and through the top material flow tube located at a level above the top of the kettle. The molten thermoplastic is deposited near the top center of the kettle where it heats and displaces downward the thermoplastic at the surface of the kettle. The heat transfer oil enters the oil bath tub adjacent the thermoplastic discharge port where both the oil and thermoplastic are at their hottest temperature and is directed through and leaves the system adjacent the thermoplastic inlet port where it is heat depleted. When the system is disengaged and circulation ceases the hydraulic motors are run in a reverse direction to purge as much thermoplastic from all tubes except for the inlet tube. This will leave solid material in only the first tube so that when the system is restarted it will take less heat and hydraulic energy to engage the system and begin moving molten material.

There is a limit to the various available energy outputs of mobile equipment systems that can be incorporated in thermoplastic equipment such as heat, electrical, engine, hydraulic air and other systems. Some serious draw backs to thermoplastic oil bath auxiliary heat exchanger systems are that they require a separate high BTU boiler system, separate hot oil circuits as well as oil expansion chambers designed for use with exotic heat transfer oils some of which require inert gas blanket interfacing. The high BTU output boilers required need more space than is available on most thermoplastic application trucks. Where they can be used they require special designs and fabrication. Motors to run the hydraulics and oil circulation systems also are subject to space limitations. Weight is also a serious consideration. For each pound that the system weighs the carrying capacity of the thermoplastic application truck is reduced by a similar amount. Costs are high for all of the system components.

BRIEF SUMMARY

According to various features, characteristics and embodiments of the present invention which will become apparent as the description thereof proceeds, the present invention provides an improvement for a melter kettle used for melting thermoplastic pavement marking material wherein the melter kettle is provided with a combustion chamber the improvement comprising a tube assembly coupled to a side portion of the melter kettle and located within a heat chamber that surrounds the melter kettle through which heat chamber hot combustion gases from the combustion chamber can flow upward around the tube assembly, the tube assembly including an odd number of vertical tubes that are connected at the tops and bottom in a serpentine manner, the tube assembly is coupled at one end to a lower portion of the melter kettle and coupled at another end to the top of the melter kettle for receiving molten thermoplastic from the lower portion of the melter kettle and discharging molten thermoplastic material to the top of the melter kettle.

The present invention further provides a melter kettle for melting thermoplastic pavement marking material which comprises:

a melter kettle having a combustion chamber adjacent a bottom of the melter kettle and a heat chamber that surrounds the melter kettle; and a tube assembly coupled to a side portion of the melter kettle and located within the heat chamber through which heat chamber hot combustion gases from the combustion chamber can flow upward around the tube assembly, the tube assembly including an odd number of vertical tubes that are connected at the tops and bottom in a serpentine manner, the tube assembly is coupled at one end to a lower portion of the melter kettle and coupled at another end to the top of the melter kettle for receiving molten thermoplastic from the lower portion of the melter kettle and discharging molten thermoplastic material to the top of the melter kettle.

The present invention also provides a method of melting a thermoplastic material in a melter kettle having a lower combustion chamber and a heat chamber surrounding the melter kettle, said method comprising:

charging thermoplastic material into the melter kettle;

combusting a fuel source in the combustion chamber to heat and melt the thermoplastic material in the melter kettle;

providing a tube assembly comprising an odd number of a plurality of tubes for heating and transferring thermoplastic material from a bottom of the melter kettle to a top of the melter kettle, the tube assembly being coupled to a side portion of the melter kettle and located within the heat chamber;

transporting molten thermoplastic material from the bottom of the melter kettle through the tube assembly and into the top of the melter kettle.

BRIEF DESCRIPTION OF THE DRAWINGS

The present invention will be described with reference to the attached drawings which are given as non-limiting examples only, in which.

DETAILED DESCRIPTION OF THE DRAWINGS AND THE PRESENTLY PREFERRED EMBODIMENTS

Figure 1:
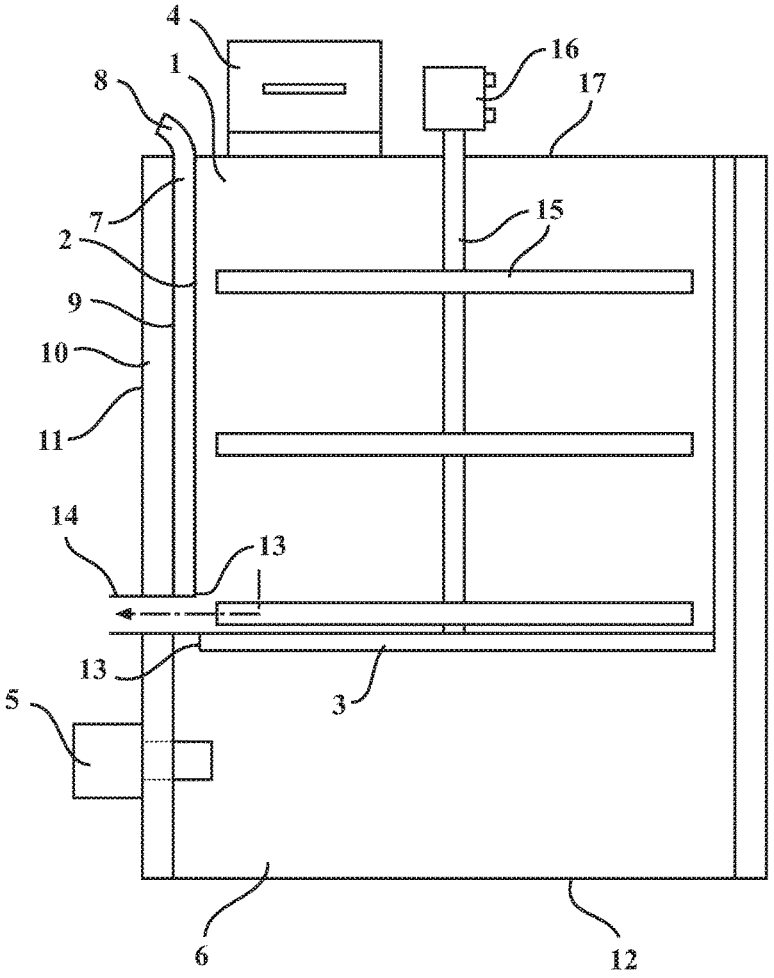
FIG. 1 is a cut away side view of a conventional air jacket thermoplastic melting kettle.

An object of the present invention is to reduce the melting time of thermoplastic pavement marking material that is melted in thermoplastic kettles that may be stationary, mounted on support trucks, support trailers or on truck mounted thermoplastic application vehicles where the vehicle is the applicator. It has long been recognized that the rate of melting thermoplastic in kettles has not been able to keep up with improvements in application equipment that have increased the rate at which the thermoplastic material can be applied. While methods of application and equipment development have increased the rate of application, production melting capacity has recently lagged far behind the ability to apply the material.

The present is based upon the recognition that material melts at a faster rate at the bottom of a melter kettle, that there is a temperature gradient between the base and sides of a melter kettle, and that there is a temperature gradient from the bottom of the sides to the top of the sides of a melter kettle. The present invention takes advantage of the fact that material in a melter kettle melts most efficiently at the bottom and more efficiently from the center of the kettle towards the sides than from the sides towards the center. Therefore, while a melter kettle without a heat dome can be used in conjunction with the present invention, using a kettle with a heat dome and heat dome temperature regulation system is preferred as the rate of melting and rate of application will be greatly improved.

The present invention first increases the rate of melting thermoplastic pavement marking material by increasing the heat differential between the application temperature of the thermoplastic and the temperature of the medium that transfers heat across the plurality of interconnected heat transfer tubes as compared to previous systems. Second the present invention provides a lower tube interface insulation chamber for the tube bottom interfaces of the plurality of interconnected tubes to make it possible for that greater heat differential. Third according to the present invention the lower tube interface insulation chamber provides access to the lower interfaces of the heat exchanger tubes for servicing. Fourth the present invention provides a full depth bottom insulation chamber that supports the lower tube interface insulation chamber and provides protection from outer kettle wall radiated heat radiating from the combustion chamber.

According to the invention the thermoplastic material in a melter kettle is heated to a viscosity where it will enter the heat chamber fired auxiliary heat exchanger intake at the base of the kettle where the material is hottest. Then the heated, molten material moves through the heat exchanger tubes of a tube assembly by action of counter rotating augers to the top of the last tube's outlet where it is deposited into the top of the melter kettle and mixed by action of agitators with the cooler material at the top of the kettle thereby increasing the overall rate of heating. Additionally, a heat dome and chimney stack tube can be incorporated to greatly increase the rate of heating in the base of the kettle such that the material being introduced at the top of the kettle transfers more heat to the material at the top of the kettle thereby reducing melting time as compared to melter kettle without a heat dome system.

Another aspect of this invention is based upon dynamic heat exchange. The action of heating material by moving material from the bottom of the kettle to the top of the kettle where material is added and therefore coolest is passive. The heat exchange system of the present invention is also a dynamic system whereby combustion chamber fired air is heated to a temperature well above that of the temperature required to apply thermoplastic and is circulated through, up and out of a chimney stack of the extended heat chamber surrounding the variable number of interconnected tubes through which the thermoplastic flows by action of counter rotating augers. Heat is transferred from the hot combustion gases through the tube walls and into the thermoplastic. The addition and use of this type of system to a thermoplastic kettle makes it now possible to keep up with the rate of application of thermoplastic from high output application equipment.

FIG. 1 is a cut away side view of a conventional air jacket thermoplastic melting kettle.

Kettle melting chamber 1 is defined between the kettle side wall 2, kettle bottom 3, and top of the kettle. Pavement marking thermoplastic material in either granular or solid form is added into the kettle melting chamber through material fill chute 4 that is provided with a safety splash back preventer (not shown) to protect the material handler from burns. A diesel-fired or other type of burner 5 is attached to the outside of the kettle 1 adjacent the combustion chamber 6 to provide the heat energy required to heat the material to a molten state and maintain it at the correct application temperature. External air is introduced at burner 5 to allow for combustion. The heated air within the combustion chamber acts upon the kettle bottom 3 first and then flows towards the outside of the kettle wall 2 where it enters and travels up the heat chamber 7 and exhausts the system through exhaust stacks 8. It is this action that defines the system in FIG. 1 as an air jacket kettle.

A temperature gradient is created from the kettle bottom 3 where it is hottest and to the top most point on the kettle side wall 2 where the temperature is coolest. Heat transfer is most efficient at the hottest point of the kettle bottom and loses efficiency adjacent the upper portions of the kettle wall 2. The heat chamber is surrounded by an outer heat chamber/inner insulation chamber wall 9 and insulation chamber 10 in which there is insulation shielding the external surface from radiant heat. An outer insulation skin 11 surrounds the melter kettle and the kettle assembly base 12 also contains insulation and provides support for the structure. Molten thermoplastic material exits the kettle shown in FIG. 1 through a bottom kettle weldment port 13 and bottom kettle transfer tube 14 to the application equipment. Molten thermoplastic material within the kettle melting chamber 1 is mixed by an agitator assembly 15 that is controlled by a counter rotating motor 16. The melting kettle lid 17 connects and supports in place the kettle wall assemblies.

Figure 2:
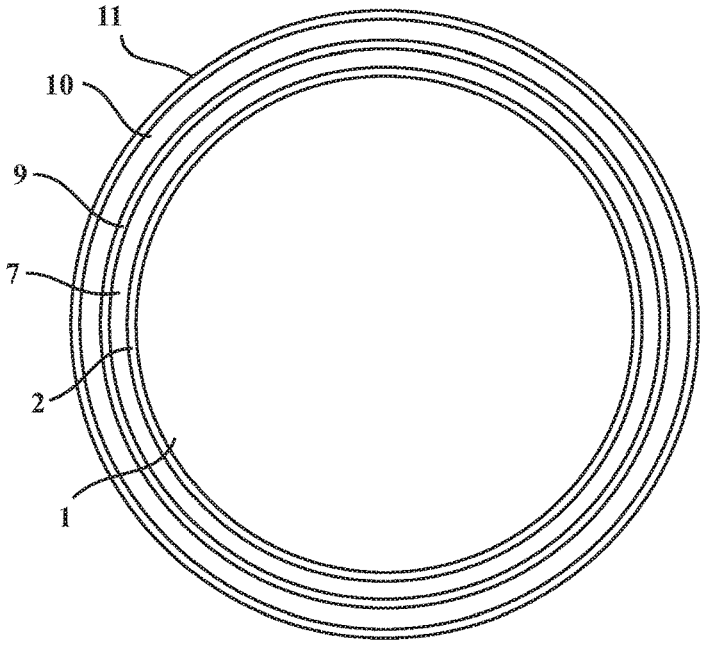
FIG. 2 is a cut away top view of the air jacket melting kettle of FIG. 1 that has a round configuration.

FIG. 2 is a cut away top view of the air jacket melting kettle of FIG. 1 that has a round configuration. Other wall and chamber configurations such as straight, angular or curved that define the kettle melting chamber 1 can be used in melting kettle designs. Shown in FIG. 2 are the heat chamber 7, the outer heat chamber/inner insulation chamber wall 9, insulation chamber 10 and outer insulation skin 11.

Figure 4:
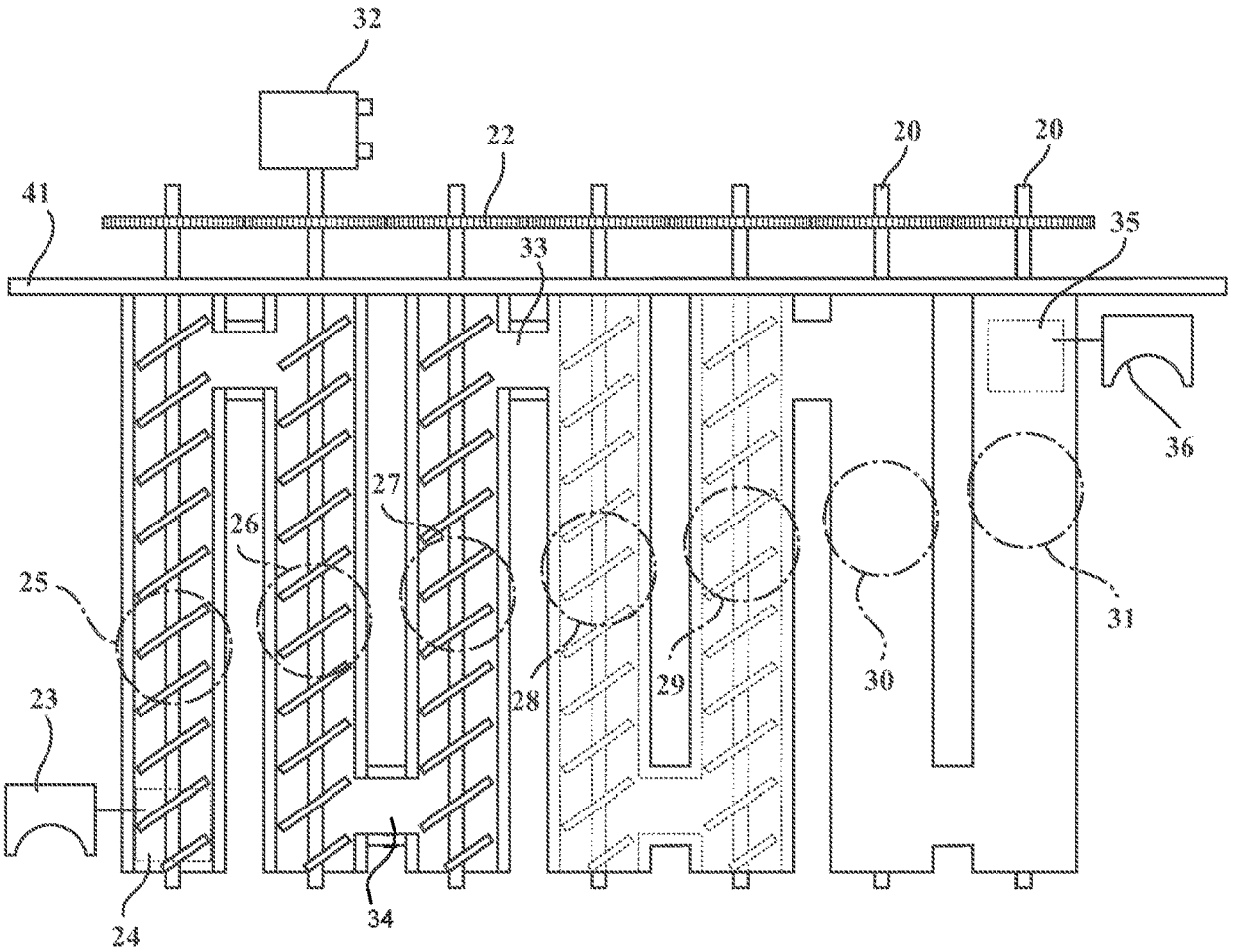
FIG. 4 is a cut away side view of the tube assembly of FIG. 3.
Figure 3:
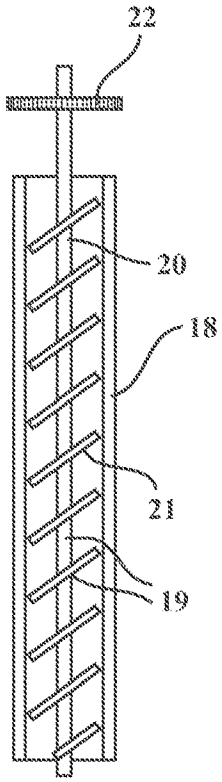
FIG. 3 is a cut away end view of a tube assembly according to one embodiment of the present invention.

FIG. 3 is a cut away end view of a tube assembly that is used as an auxiliary heating means according to one embodiment of the present invention. FIG. 4 is a cut away side view of the tube assembly of FIG. 3.

All tubes 18 of the tube assembly can be of equal diameters and lengths with each having an auger 19 with equal length and diameter shafts 20 and all flights 21 running in the same direction in each tube 18. Each tube 18 has an identical upper interface assembly (See FIG. 5) and a lower interface assembly (See FIG. 6). Attached to the top of the auger shafts 20 are co-engaging gears 22.

As shown in FIG. 4 the tube assembly includes an odd number of interconnected tubes 18 with seven tubes 18 shown by way of a non-limiting example. A bottom kettle transfer tube 23 connects the bottom of the kettle to the bottom 24 of the first tube 25. A counter rotational motor 32 is connected to any one of the gears 22 through its auger shaft 20. As the motor rotates, each engaged adjacent gear turns in an opposite direction driving augers and causing molten thermoplastic to circulate up and down through adjacent tubes 18 in a serpentine manner. The direction of flow in the connected tubes 18 (also sequentially numbered 25-31) can be reversed as desired by changing the direction of rotation of motor 32.

At the top of the first tube 25 and the second tube 26 there is a top tube cross over connector 33 that allows material to flow between the tubes. At the bottom of the second tube 26 and the bottom of the third tube 27 there is a bottom tube cross over connector 34 that allows material to flow between the tubes. This pattern of cross over connectors is repeated between tubes 28-31 as shown in FIG. 4. When molten thermoplastic flowing through the tube assembly reaches the top 35 of the last tube 31 it passes through kettle wall 2 and into the kettle chamber 1 through the top kettle transfer tube 36. The complete assembly is connected through a top mounting plate 41.

Figure 5:
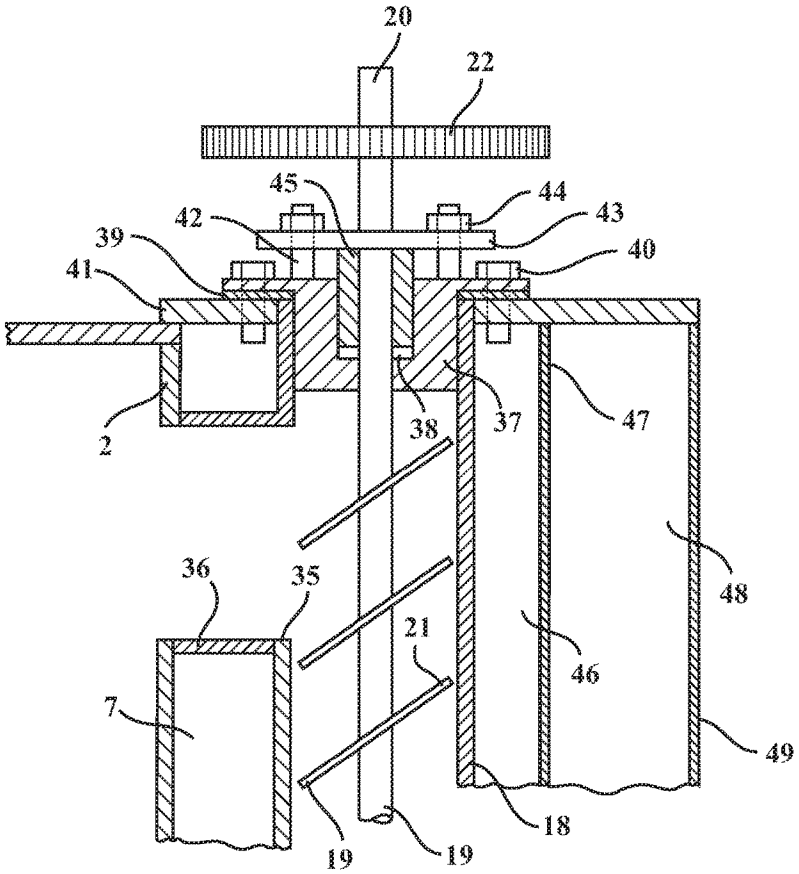
FIG. 5 is a cut away view of an upper interface assembly according to one embodiment of the present invention

FIG. 5 is a cut away view of an upper interface assembly according to one embodiment of the present invention. As shown in FIG. 5 the top of tube 18 (representing the tube 31) including the auger shaft 20 and flights 21 is attached to the top of the kettle chamber 1 with top kettle transfer tube 36 in fluid communication with the kettle chamber 1 and tube 18. A compression gasket 38 surrounds the auger shaft 20 to prevent molten thermoplastic from leaking from tube 18. The compression gasket 38 is received in a top flange 37 as shown. A gasket seal 39 is provided beneath the outwardly extending top of top flange 37 and is drawn tight by a bolt 40 against the top mounting plate 41. Studs 42 are affixed to the top flange 37. Centered on the studs is a ram 43 that is forced down by adjuster nuts 44 thereby compressing a bushing 45 downward to seal the auger shaft 20. Also shown in FIG. 5 are the heat chamber 7 adjacent the kettle chamber 1, the extended heat chamber 46, the extended outer heat chamber wall 47, the extended insulation chamber 48 and the outer extended insulation skin 49.

Figure 6:
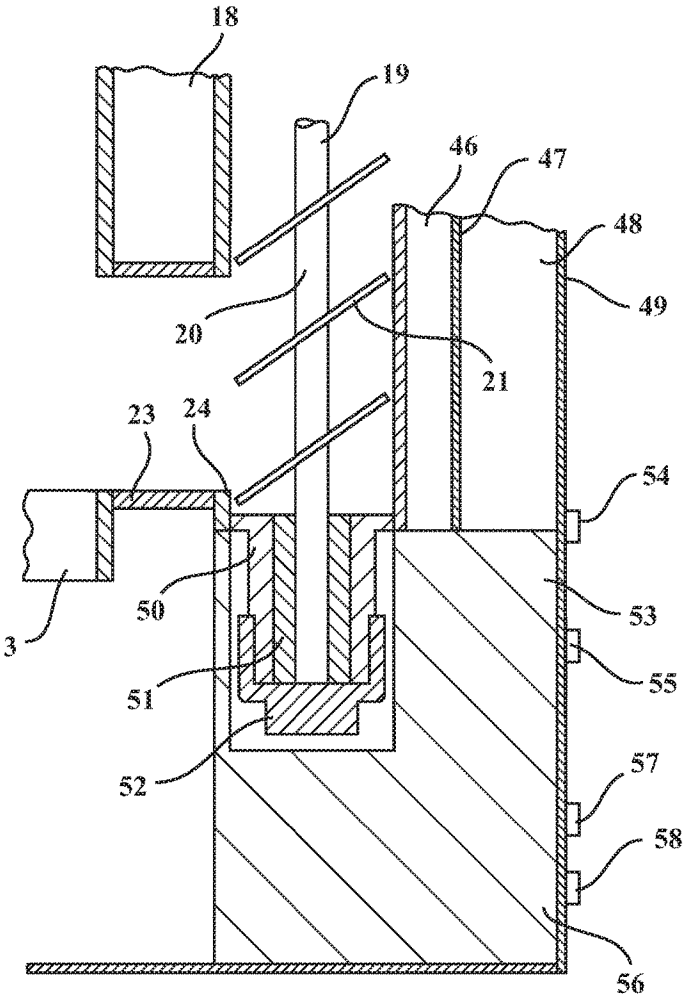
FIG. 6 is a cut away view of a lower interface assembly according to one embodiment of the present invention.

FIG. 6 is a cut away view of a lower interface assembly according to one embodiment of the present invention. As shown in FIG. 6 the bottom 24 of tube 18 (representing the tube 25) including the auger shaft 20 and flights 21 is attached to the bottom of the kettle chamber 1 via bottom kettle transfer tube 23 through which molten thermoplastic material can flow in either direction as determined by the rotational direction of auger shaft 20. When the tube assembly of FIG. 4 is attached to the side of the kettle wall 2 it extends the heat chamber 7 outward such that there is an extended heat chamber 46 surrounding the tube assembly. In addition the outer heat chamber wall 9 is extended at 47, the insulation chamber 10 is extended at 48, and the outer insulation skin 11 is extended at 49. A lower interface flange 50 is attached to the bottom of each tube 18. The lower interface flanges are surrounded by bushings 51 within which the auger shafts 20 rotate. A lower flange cap 52 screws onto the lower interface flange 50 creating a mechanical seal to prevent leaking.

A removable lower tube insulation compartment 53 that shields the tube assembly from the extreme heat of the combustion chamber 6 is shown in FIG. 6. The lower tube insulation compartment 53 is held in place by latches 54 and has handles 55 for easily removal. Below the lower tube insulation compartment 53 is a second lower insulation compartment 56 which, when removed, allows the lower tube interface chamber 53 to drop down below the bottom level of the lower flange cap 52 and slide out allowing access to all of the bottom of the tube assembly. Lower insulation compartment 53 has latches 57 holding it in place and handles 58 for easy removal.

Figure 7:
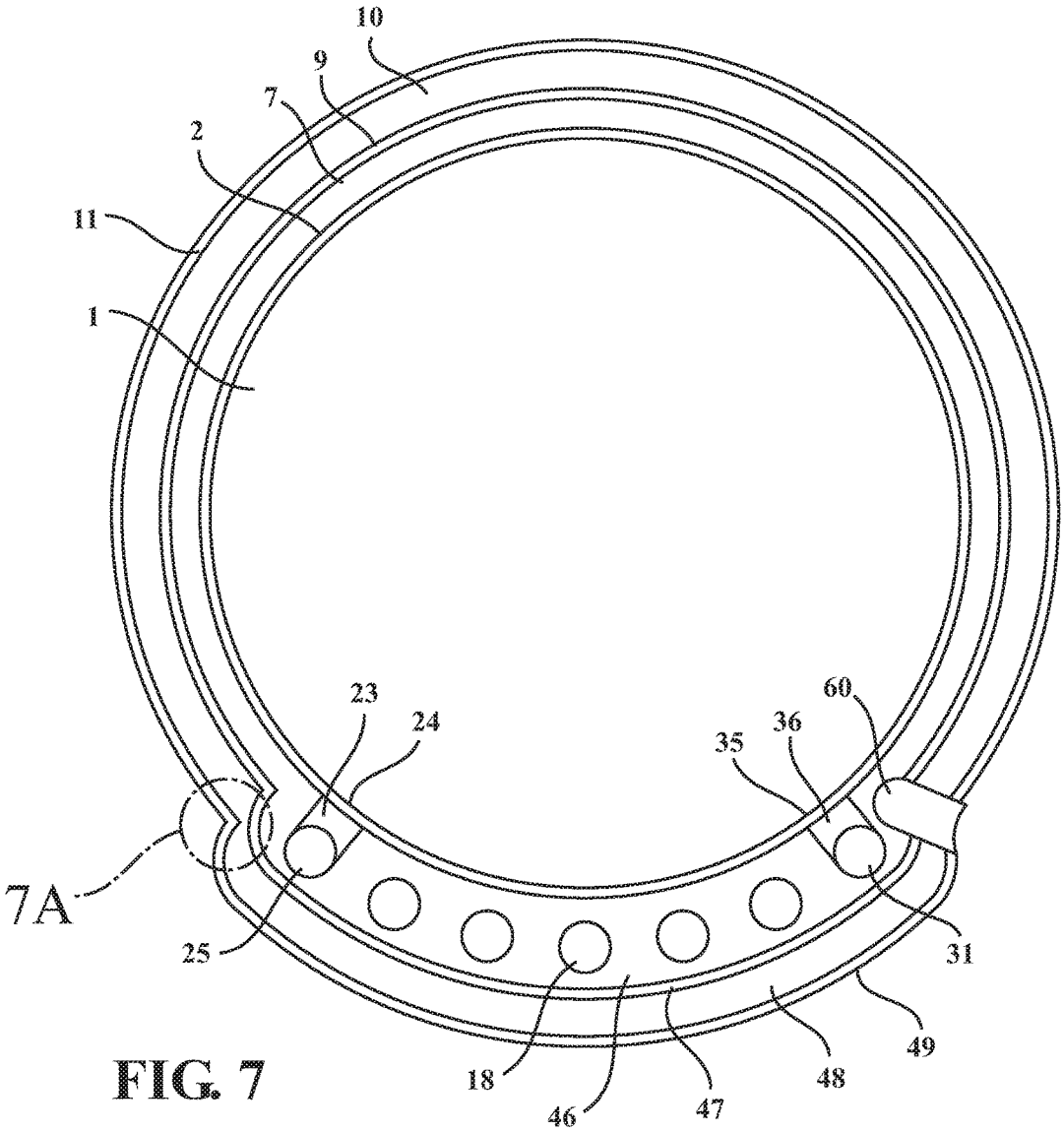
FIG. 7 is a cut away top view of the wall structures and chambers of an air jacket melting kettle having the tube assembly of FIG. 4 coupled thereto.
Figure 7A:
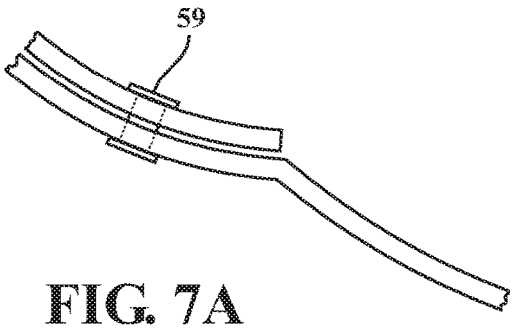
FIG. 7A is an enlarged portion of FIG. 7 that is circled in broken lines which shows details of a mechanical connector that connects the extended walls of the insulated chamber.

FIG. 7 is a cut away top view of the wall structures and chambers of an air jacket melting kettle having the tube assembly of FIG. 4 coupled thereto. Bottom kettle transfer tube 23 connects the bottom of the kettle chamber 1 to the bottom 24 of the first tube 25. Top kettle transfer tube 36 connects the top 35 of the last tube 31 the top of the kettle chamber 1. The heat chamber 7 extends outward forming the extended heat chamber 46 that surrounds tubes 18 of the tube assembly of FIG. 4. The outer heat chamber/inner insulation chamber wall 9 extends outward around the extended heat chamber 46 forming extended outer heat chamber/inner insulation chamber wall 47. The insulation chamber 10 extends outward creating the extended insulation chamber 48 and the outer insulation skin 11 extends outward creating the extended outer insulation skin. The extended walls are connected to the walls by removable mechanical connectors 59 so as to provide access to the complete assembly (See FIG. 7A). At the top of the heat chamber/extended heat chamber is an exhaust stack 60 that is added to the kettle to vent heat depleted exhaust gases from the extended heat chamber improving heat exchange across the walls of tubes 18.

Figure 8:
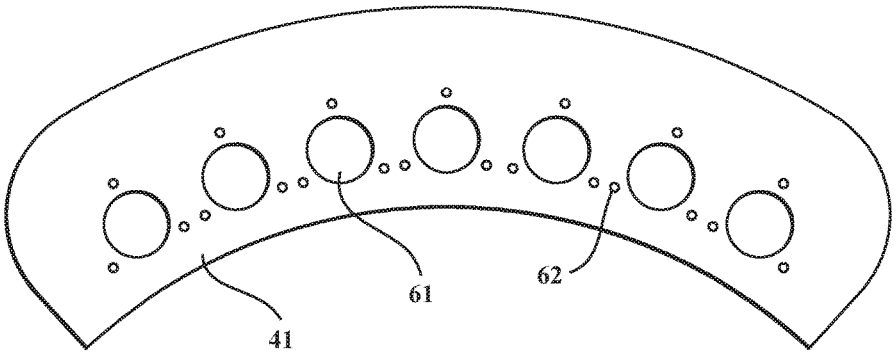
FIG. 8 is a top view of the top mounting plate with tube locator holes and threaded flange attachment holes.

FIG. 8 is a top view of the top mounting plate 41 with locator holes 61 to which the tops of tubes 18 are welded in place. Threaded holes 62 are located such that the top flanges 37 can be bolted in place.

Figure 9:
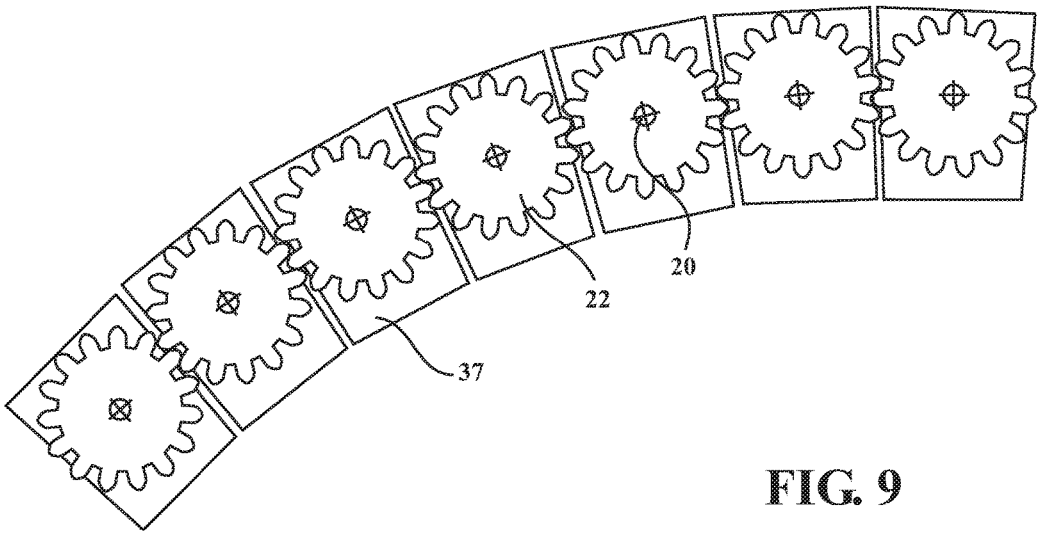
FIG. 9 is a top view of the gear train, auger shafts and top interface flanges.

FIG. 9 is a top view showing the orientation of the top flanges 37, gears 22 in a gear train arrangement and the auger shafts 20.

Figure 10:
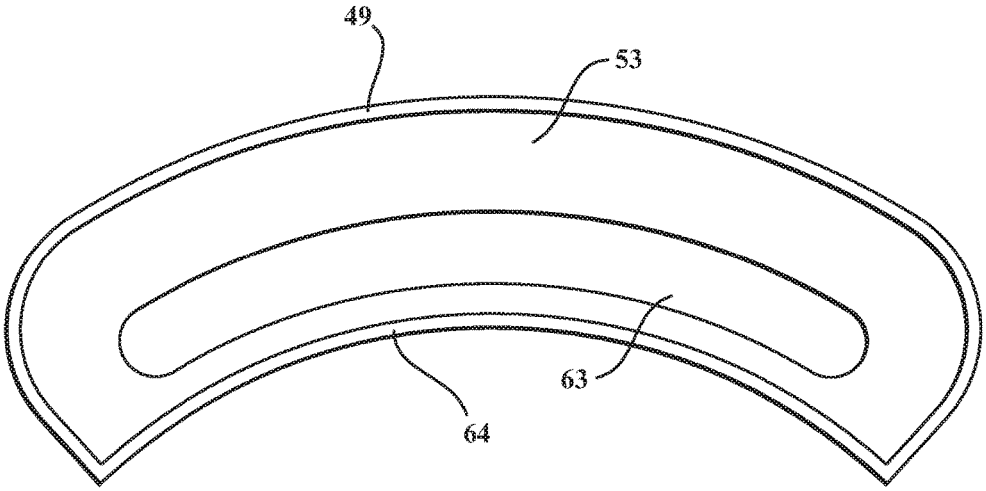
FIG. 10 is a top view of the lower tube interface insulation chamber.

FIG. 10 is a top view of the removable lower tube interface insulation chamber 53 with its face being a downward extension of the extended insulation skin 49 where a channel 63 in the insulation is located shielding the lower interface assembly of the tube assembly from direct exposure to combustion chamber 6 heat. Inner wall 64 provided at the inner face of lower tube interface insulation chamber 53 abutting the combustion chamber 6.

Figure 11:
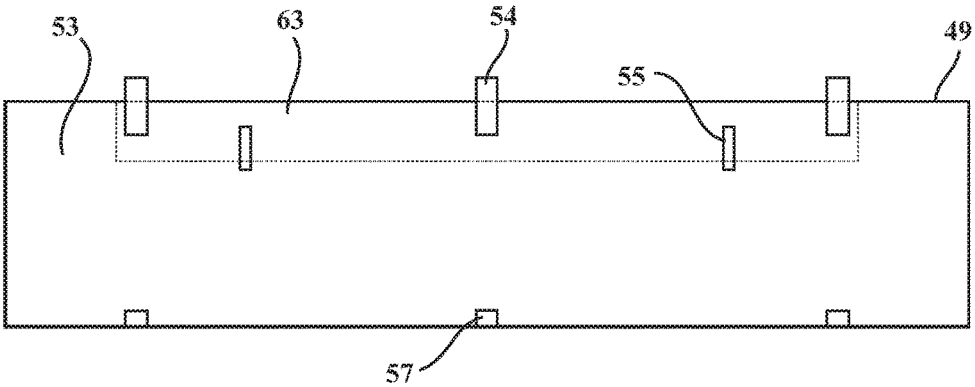
FIG. 11 is a front view of the lower tube interface insulation chamber.

FIG. 11 is a front view of the removable lower tube interface insulation chamber 53 with the dotted line indicating the depth and location of the channel 63 in the lower tube interface insulating chamber. Latches 54 hold the top of the removable chamber to the extended outer insulation skin 49 and handles 55 make for easy removal. Latch top catches 57 are provided to allow the lower insulation compartment 56 to be secured in place.

Figure 12:
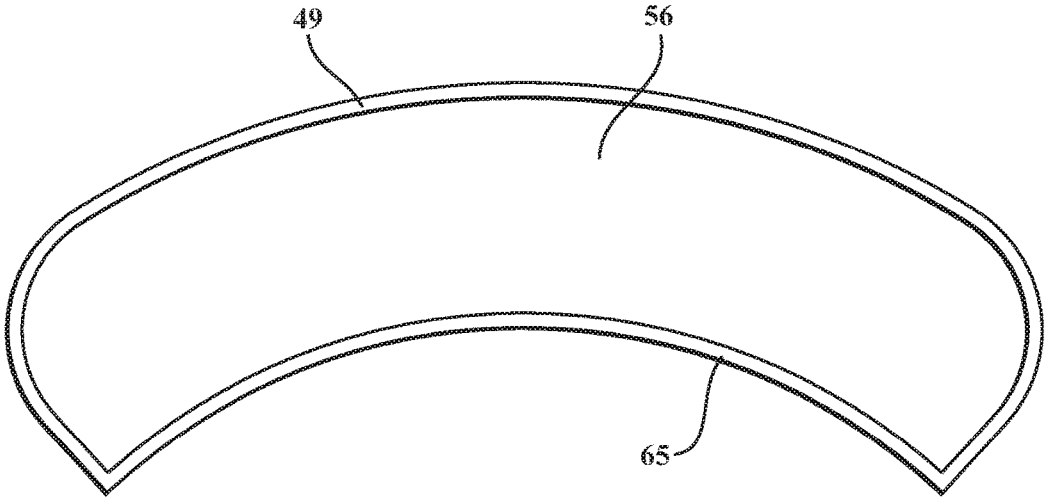
FIG. 12 is a top view of the lower insulation compartment.

FIG. 12 is a top view of the second lower insulation compartment 56 which not only provides an insulation function but when removed allows the removable lower tube interface chamber 53 to drop down below the bottom level of the lower flange cap 52 and slide out allowing access to the bottoms of all of the tubes 18 of the tube assembly of FIG. 4. An inner wall 65 at the inner face of the second lower insulation compartment 56 abuts the combustion chamber.

Figure 13:
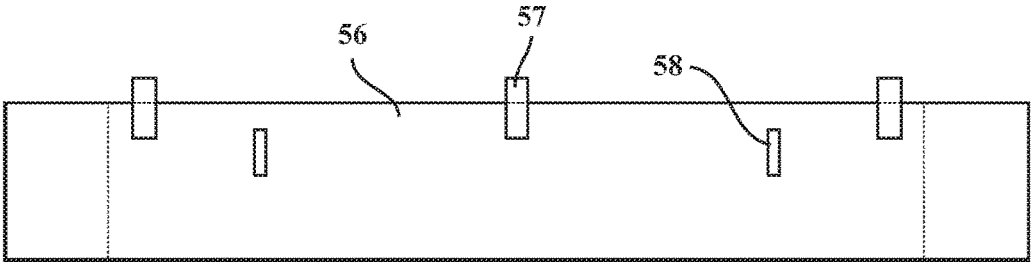
FIG. 13 is a front view of the lower insulation compartment.

FIG. 13 is a front view of the lower insulation compartment 56 that depicts latches 57 and handles 58.

Figure 14:
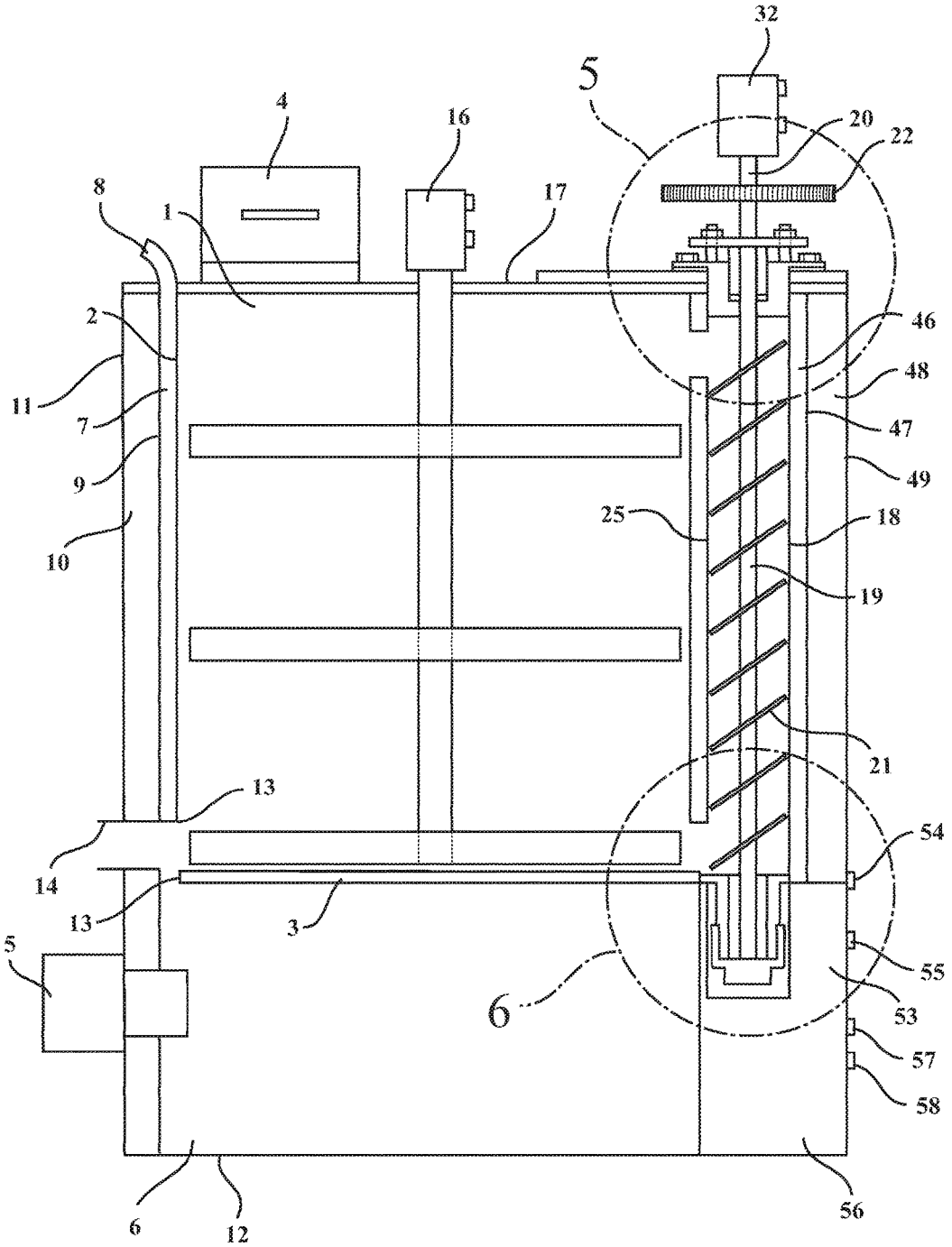
FIG. 14 is a cut away side view of an air jacket thermoplastic melting kettle having the tube assembly of the present invention provided in the extended heat exchanger on the side of the melting kettle.

FIG. 14 is a cut away side view of an air jacket thermoplastic melting kettle having the tube assembly of the present invention provided in the extended heat exchanger on the side of the melting kettle. The details of the upper interface assembly between the tube assembly and the melting mettle are shown in FIG. 5 as noted and the details of the lower interface assembly between the tube assembly and melting kettle are shown in FIG. 6 as indicated. A comparison between FIGS. 1 and 14 provides and understanding of how the tube assembly can be incorporated into/onto a melter kettle and how the extending heat chamber 46 and extended insulation chamber 48 extend around the tube assembly. Although note shown it is to be understood from the description above that a melter kettle with a heat dome could also be used Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above and set forth in the attached claims.

The invention claimed is:

1. In a melter kettle for melting thermoplastic pavement marking material wherein the melter kettle is provided with a combustion chamber the improvement comprising a tube assembly coupled to a side portion of the melter kettle and located within a heat chamber that surrounds the melter kettle through which heat chamber hot combustion gases from the combustion chamber can flow upward around the tube assembly, the tube assembly including an odd number of vertical tubes that are connected at the tops and bottom in a serpentine manner, the tube assembly is coupled at one end to a lower portion of the melter kettle and coupled at another end to the top of the melter kettle for receiving molten thermoplastic from the lower portion of the melter kettle and discharging molten thermoplastic material to the top of the melter kettle.

2. The melter kettle of claim 1, wherein the heat chamber includes an extended portion that surrounds the tube assembly.

3. The melter kettle of claim 1, further including an insulation chamber that surrounds the tube assembly.

4. The melter kettle of claim 1, wherein each tube of the tube assembly contains an auger for transferring molten thermoplastic material therethrough.

5. The melter kettle of claim 4, wherein a common drive motor rotates each of the augers.

6. The melter kettle of claim 1, further comprising a heat dome chamber in the bottom of melter kettle.

7. The melter kettle of claim 6, further comprising an exhaust gas conduit that is provided between the top of the heat dome chamber and the top of the melter kettle through which exhaust gas conduit combustion gases received in the heat dome chamber can be exhausted from the top of the melter kettle.

8. A melter kettle for melting thermoplastic pavement marking material which comprises:

a melter kettle having a combustion chamber adjacent a bottom of the melter kettle and a heat chamber that surrounds the melter kettle; and a tube assembly coupled to a side portion of the melter kettle and located within the heat chamber through which heat chamber hot combustion gases from the combustion chamber can flow upward around the tube assembly, the tube assembly including an odd number of vertical tubes that are connected at the tops and bottom in a serpentine manner, the tube assembly is coupled at one end to a lower portion of the melter kettle and coupled at another end to the top of the melter kettle for receiving molten thermoplastic from the lower portion of the melter kettle and discharging molten thermoplastic material to the top of the melter kettle.

9. The melter kettle of claim 8, wherein the heat chamber includes an extended portion that surrounds the tube assembly.

10. The melter kettle of claim 8, further including an insulation chamber that surrounds the tube assembly.

11. The melter kettle of claim 8, wherein each tube of the tube assembly contains an auger for transferring molten thermoplastic material therethrough.

12. The melter kettle of claim 11, wherein a common drive motor rotates each of the augers.

13. The melter kettle of claim 8, further comprising a heat dome chamber in the bottom of melter kettle.

14. The melter kettle of claim 13, further comprising an exhaust gas conduit that is provided between the top of the heat dome chamber and the top of the melter kettle through which exhaust gas conduit combustion gases received in the heat dome chamber can be exhausted from the top of the melter kettle.

15. A method of melting a thermoplastic material in a melter kettle having a lower combustion chamber and a heat chamber surrounding the melter kettle, said method comprising:

charging thermoplastic material into the melter kettle;

combusting a fuel source in the combustion chamber to heat and melt the thermoplastic material in the melter kettle;

providing a tube assembly comprising an odd number of a plurality of tubes for heating and transferring thermoplastic material from a bottom of the melter kettle to a top of the melter kettle, the tube assembly being coupled to a side portion of the melter kettle and located within the heat chamber;

transporting molten thermoplastic material from the bottom of the melter kettle through the tube assembly and into the top of the melter kettle.

16. A method of melting a thermoplastic material in a melter kettle according to claim 15, wherein a portion of combustion gases formed in the combustion chamber pass through the heat chamber and transfer heat into the tube assembly.

17. A method of melting a thermoplastic material in a melter kettle according to claim 15, wherein a heat dome is provided in the bottom of the melter kettle.

18. A method of melting a thermoplastic material in a melter kettle according to claim 17, further comprising exhausting combustion gases from a top of the heat dome chamber to a top of the melter kettle through an exhaust conduit.

19. A method of melting a thermoplastic material in a melter kettle according to claim 15, wherein the molten thermoplastic material is transported through the tube assembly by a plurality of augers.

20. A method of melting a thermoplastic material in a melter kettle according to claim 15, wherein the heat chamber includes an extended portion that surrounds the tube assembly.

* * * * *